US008998451B2

(12) United States Patent
Crognale

(10) Patent No.: US 8,998,451 B2
(45) Date of Patent: Apr. 7, 2015

(54) CUSTOMIZABLE DECORATIVE PARTY APPARATUS

(71) Applicant: Ronald Dominick Crognale, Baltimore, MD (US)

(72) Inventor: Ronald Dominick Crognale, Baltimore, MD (US)

( * ) Notice: Subject to any disclaimer, the term of this patent is extended or adjusted under 35 U.S.C. 154(b) by 194 days.

(21) Appl. No.: 13/684,527

(22) Filed: Nov. 24, 2012

(65) Prior Publication Data

US 2014/0146537 A1 May 29, 2014

(51) Int. Cl.

| | |
|---|---|
| ***F21V 21/008*** | (2006.01) |
| ***F21V 31/00*** | (2006.01) |
| ***G09F 3/00*** | (2006.01) |
| ***F21S 4/00*** | (2006.01) |
| ***G09F 3/20*** | (2006.01) |
| ***G09F 7/02*** | (2006.01) |

(52) U.S. Cl.

CPC . *G09F 3/00* (2013.01); *F21S 4/001* (2013.01); *G09F 3/20* (2013.01); *G09F 7/02* (2013.01); *Y10S 362/804* (2013.01)

(58) Field of Classification Search

USPC ..... 362/103, 109, 249.16, 253, 806, 653, 362/654; 40/324; 239/33; 428/7, 11

See application file for complete search history.

(56) References Cited

U.S. PATENT DOCUMENTS

| | | | | |
|---|---|---|---|---|
| 338,111 | A | 3/1886 | Smith | |
| 2,976,629 | A | 3/1961 | Brixius | |
| 3,694,648 | A * | 9/1972 | Yates | 362/311.03 |
| 4,224,364 | A * | 9/1980 | Hunt | 428/11 |
| 4,275,518 | A | 6/1981 | Martin | |
| 5,014,400 | A | 5/1991 | Ban | |
| 5,239,450 | A * | 8/1993 | Wall | 362/104 |
| 5,985,379 | A * | 11/1999 | Longsdorf | 428/13 |
| 6,226,908 | B1 * | 5/2001 | Byers | 40/575 |
| 6,253,918 | B1 * | 7/2001 | Greiner | 206/457 |
| 6,420,008 | B1 * | 7/2002 | Lewis | 428/78 |
| 6,505,426 | B2 | 1/2003 | Yang | |
| 6,948,841 | B2 * | 9/2005 | Tsai | 362/565 |
| 7,093,832 | B2 | 8/2006 | Parker | |
| 7,131,745 | B2 * | 11/2006 | Sibbett | 362/106 |
| 7,717,584 | B1 * | 5/2010 | Tuan | 362/103 |
| 8,636,170 | B2 * | 1/2014 | Lafever | 220/710 |
| 2003/0131513 | A1 * | 7/2003 | Runge | 40/718 |
| 2003/0157279 | A1 | 8/2003 | Rudish | |
| 2004/0187370 | A1 | 9/2004 | Buzby | |
| 2006/0026879 | A1 | 2/2006 | Tebaldi | |

(Continued)

FOREIGN PATENT DOCUMENTS

| | | |
|---|---|---|
| DE | 20006936 | 10/2006 |
| GB | 2191678 | 12/1987 |

(Continued)

*Primary Examiner* — Peggy Neils
(74) *Attorney, Agent, or Firm* — Martin & Ferraro, LLP

(57) ABSTRACT

A customizable decorative party apparatus. One of several possible insert photographs, name tags, decals, or logos inserts in place on a generally planer surface of a base. A substantially transparent cover removably locks onto the base, defining a substantially water-tight protective cover over the insert. The apparatus includes an attaching structure on the opposite surface, configured to temporarily, removably connect the apparatus to one of a plurality of party items, e.g., cups, plates, straws, hats, ornaments, a string of holiday lights, or the like. The apparatus can be removed from the decoration, the cover can be removed from the base by hand-manipulating the lock, and the same insert, or a different insert, can be inserted for use at the same party or a different party.

44 Claims, 9 Drawing Sheets

(56) References Cited

U.S. PATENT DOCUMENTS

| | | | | |
|---|---|---|---|---|
| 2008/0011909 | A1 | 1/2008 | Daddario | |
| 2008/0032068 | A1 | 2/2008 | Kennedy | |
| 2009/0213582 | A1* | 8/2009 | Thomas | 362/183 |
| 2012/0171647 | A1 | 7/2012 | Samenuk | |

FOREIGN PATENT DOCUMENTS

| | | |
|---|---|---|
| JP | 2006284742 | 10/2006 |
| JP | 3169512 | 8/2011 |

* cited by examiner

CUSTOMIZABLE DECORATIVE PARTY APPARATUS

FIELD OF THE INVENTION

The present invention relates to a decorative party apparatus, and more specifically to a customizable decorative party apparatus which can be removably attached to a plurality of party items, the apparatus being configured to display a removable, interchangeable insert, such as a photograph, logo, symbol, or decal, visible to a user of the party item, while simultaneously protecting the removable insert from damage.

BACKGROUND OF THE INVENTION

Description of the Related Art

Party items are known, e.g., cups, plates, straws, ornaments, light strings, and hats, imprinted or embossed with corporate symbols, political party slogans, and party expressions such as "Happy Birthday," "Happy Anniversary," "Happy Halloween," "Congratulations," "Inauguration 2013," "Bon Voyage," "Happy New Year," or the like. The vast majority of known party items, however, are not customizable, and therefore relatively impersonal. Other party items are available which allow limited customability, such as attachment to a party item of a tag printed with a name of a person, or a photograph of a person celebrating a birthday, a name and photograph of a political candidate, a photograph of a bride and groom, or a photograph of a graduate.

Such known customizable party items, however, have numerous disadvantages. For example, an attached nametag or an attached photograph typically are difficult to remove, so removability, interchangeability, and re-use of the customized portions, or re-use of the party item itself, typically is not possible, or else the customizable portion is not adequately protected from damage from liquid, food, and so forth. In addition, the customizable portion is limited with respect to the categories of party items to which it can be attached.

Accordingly, the present invention provides an affordable customizable decorative party apparatus, removably attachable (for later re-use) to a wide variety of party items, e.g., cups, plates, straws, hats, ornaments, light strings, and the like, in which an insert, e.g., a photograph, a slogan, a decal, a logo, a symbol, or the like, can be removably and interchangeably inserted, with the insert being protected from damage.

A customizable decorative party apparatus is described and claimed below. Accordingly, the present invention is directed to a customizable decorative party apparatus that substantially obviates one or more of the problems, limitations, and disadvantages of the related art.

SUMMARY OF THE INVENTION

To achieve these and other advantages and in accordance with the purpose of the invention, as embodied and broadly described, the invention, a customizable decorative party apparatus, includes a base portion having a generally planar first or upper surface, a second or lower surface, and a preselected shape; a plurality of removable interchangeable inserts having the preselected shape, configured to be inserted on the first surface; a generally transparent cover portion having the preselected shape, and attaching structure, configured to removably attach the cover portion the base portion together with a substantially watertight connection and with the removeable interchangeable insert therebetween; and a connecting structure to removably connect the base to one of a plurality of party items, e.g., plates, cups, straws, hats, ornaments, light strings, or the like. The substantial watertight connection between the locking tabs and the locking portion may be obtained via a snap-lock action, a partial thread, or a full-thread.

The base portion also may be configured with an aperture for insertion therein of a light for illumination of the removable interchangeable insert. This configuration is particularly advantageous for use with a string of holiday lights, e.g., Christmas tree lights, wherein one or more lights in the string of lights can be inserted into a base of a customizable decorative party apparatus, in order to light up the inserts, e.g., desired photographs, symbols, or the like, on the tree.

Additional features and advantages of the invention will be set forth in part in the description which follows, and in part will be obvious from the description, or may be learned by practice of the invention. The advantages of the invention will be realized and attained by means of the elements and combinations particularly pointed out in the written description and claims, as well as the attached drawings.

It is to be understood that both the foregoing general description and the following detailed description are exemplary and explanatory only and are not restrictive of the invention, as claimed.

The accompanying drawings, which are incorporated in and constitute a part of this specification, illustrate several preferred embodiments of the invention, and together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 7A:
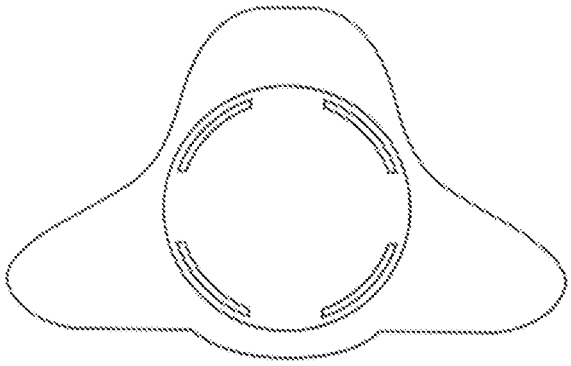
FIGS. 7A and 7B are top views of a customizable decorative party apparatus in accordance with the invention having a different preselected shape, i.e., a wedding bell.
Figure 7B:
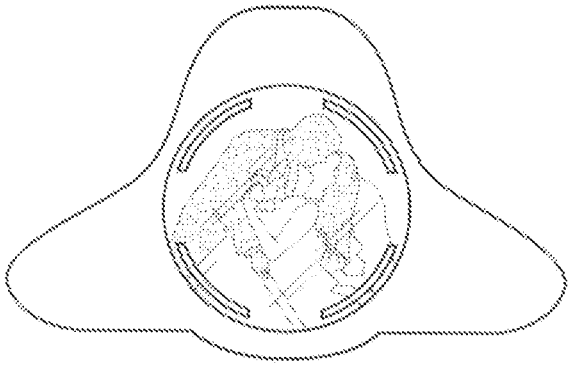

As broadly embodied herein, with reference, e.g., to FIGS. 1A-1C, and FIG. 2, a customizable decorative party apparatus 10 is provided. Party apparatus 10 comprises a base portion 12. The base portion 12 has a generally planar first or upper surface 14, and a second or lower surface 16, opposite the first/upper surface 14. In addition, the base 12 has a preselected shape. As embodied in FIGS. 1 and 2, the preselected shape is generally circular, but the invention is not limited to this shape. For example FIGS. 7A-7B depict a bell-shaped base portion 12, which would be suitable for use at a wedding reception, or the like. Other preselected shapes also are possible and within the scope of the invention, e.g., a heart-shape (not shown), for use, e.g., at a wedding shower, or a baby bottle-shape (not shown) for use at a baby shower. The preselected shape also could be text, forming a recognizable party saying, e.g., "HAPPY BIRTHDAY," "HAPPY NEW YEAR," "CONGRATULATIONS," or the like. Numerous other shapes are possible. Accordingly, the present invention is not limited to any shape.

Figure 1A:
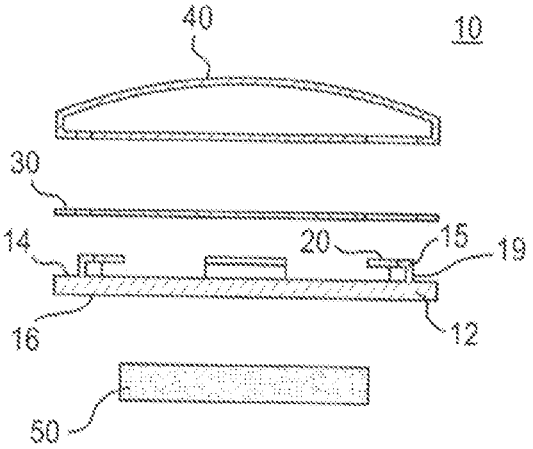
FIG. 1A is an exploded parts view of a customizable decorative party apparatus in accordance with the invention.
Figure 1B:
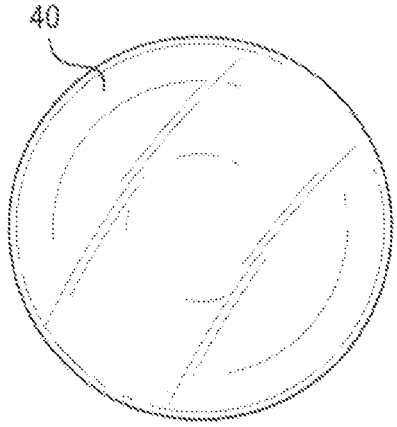
FIG. 1B is a top view of a generally transparent cover in accordance with the invention.
Figure 2:
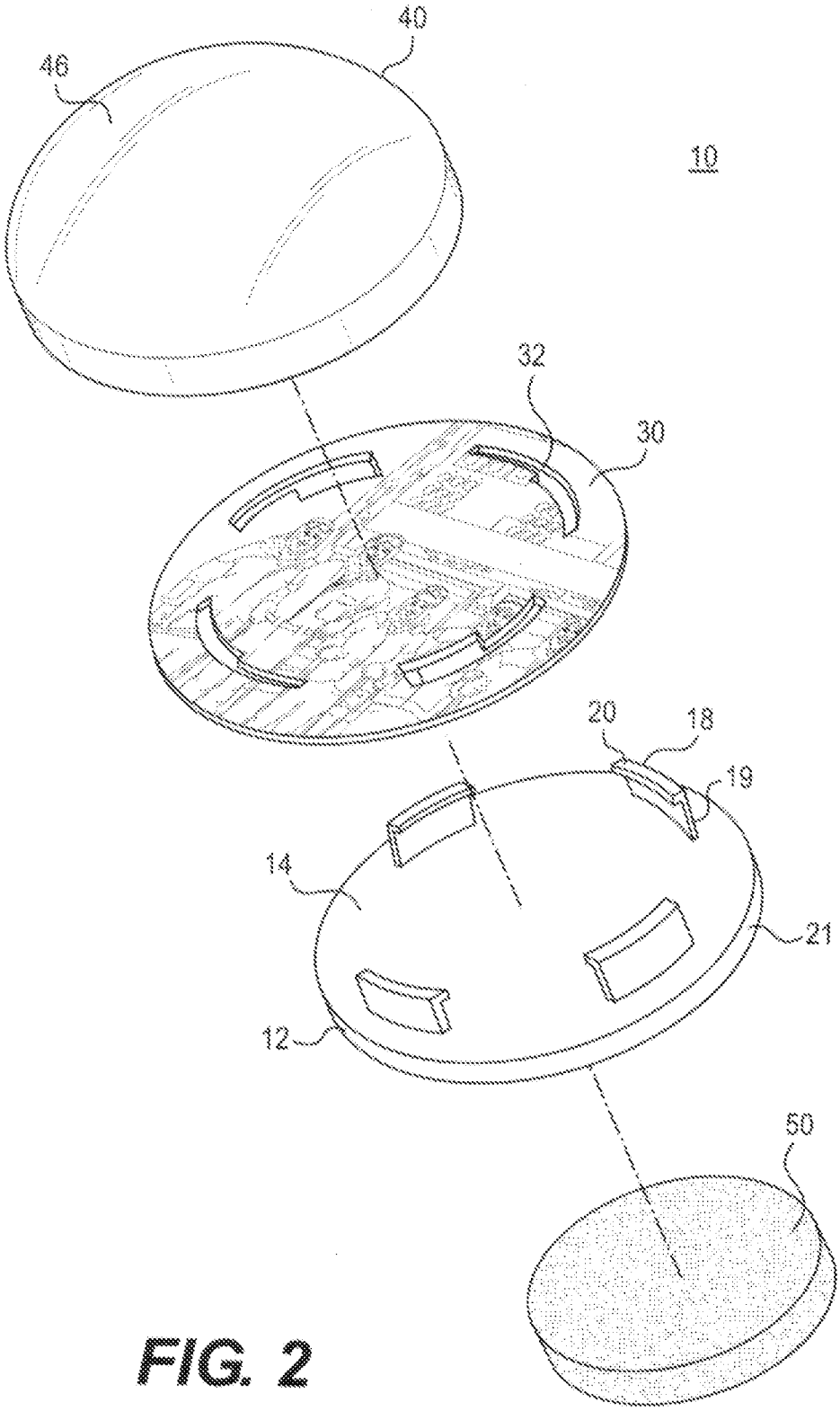
FIG. 2 is an exploded parts perspective view of a customizable decorative party apparatus in accordance with the invention.

As broadly embodied in FIGS. 1A and 2, the base portion 12 further includes at least one lock tab 18, projecting from a surface thereof, preferably from the upper surface 14. As further broadly embodied in FIG. 2, a plurality of lock tabs 18 may be provided projecting from the upper surface 14. Each lock tab 18 is generally-L shaped, with a vertical portion 19, and an inwardly-projecting portion 20. As broadly embodied in FIG. 2, each vertical portion 19 is positioned proximate a periphery 21 of the generally circular base portion 12.

Figure 1C:
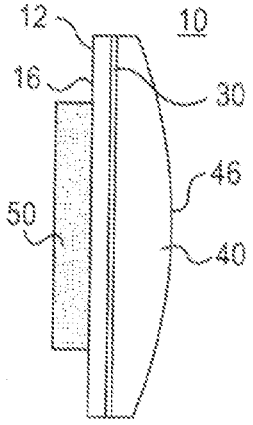
FIG. 1C is a side view depicting an assembled base portion, insert, cover portion, and connecting structure in accordance with the invention.

Decorative customizable party apparatus 10, as broadly embodied in FIGS. 1A-1C, and FIG. 2 further comprises a removable, interchangeable insert 30 having the preselected shape, configured to be inserted on one of the surfaces, preferably the generally planar first or upper surface 14 as shown in FIGS. 1A, 1C, and 2. Insert 30 has a slot 32, and preferably a plurality of slots 32, penetrating the insert, at positions corresponding to the positions of the lock tabs 18. Referring to FIG. 2, each slot 32 preferably has a wider portion and an adjoining narrower portion. When the insert 30 is placed on the base portion 12, the lock tabs 18 and the wider portions of the slots 32 will be in substantial alignment, and the lock tabs 18 will penetrate the wider portions of the slots 32.

As broadly embodied in FIGS. 1A-1C and FIG. 2, decorative customizable party apparatus 10 further comprises a substantially transparent cover portion 40 including a substantially transparent top surface 46. The transparent cover 40, when attached to the base 12, provides substantially watertight protection of the insert 30, while simultaneously allowing the insert 30 to be visible through the cover portion 40. In some embodiments, such as use of the customizable decorative party apparatus 10 with a plate, as discussed below with respect to FIGS. 5A-5C, the top surface of transparent cover 40 will be planar. In other embodiments, such as the embodiments of FIGS. 1C, 2, and 4A-4B, the top surface 46 may be shaped as a dome.

Figure 3A:
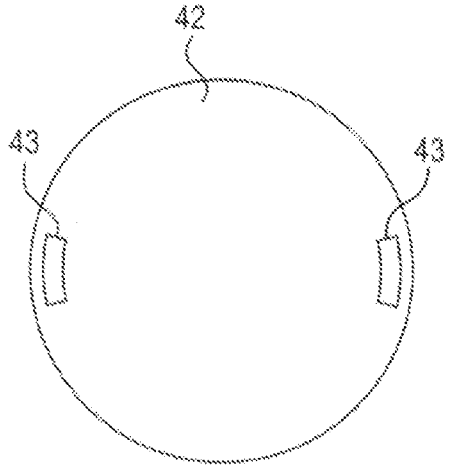
FIG. 3A is a bottom view of the generally transparent cover portion, depicting one preferred embodiment for removably locking the base portion and the cover portion together in accordance with the invention.
Figure 3B:
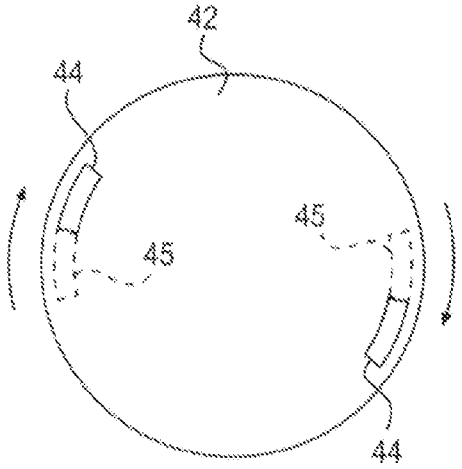
FIG. 3B is a bottom view of the generally transparent cover portion, depicting another preferred embodiment for removably locking the base portion and the cover portion together in accordance with the invention.
Figure 3C:
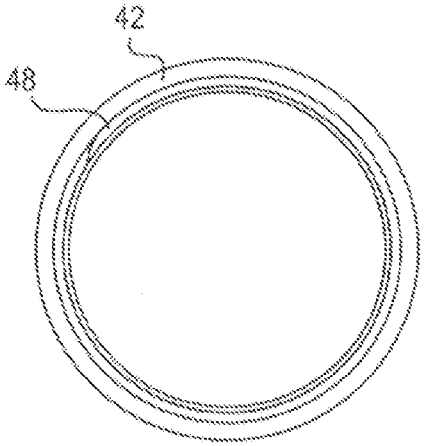
FIG. 3C is a bottom view of the generally transparent cover portion, depicting yet another preferred embodiment for removably locking the base portion and the cover portion together in accordance with the invention.

Referring to FIGS. 3A-3C, several preferred configurations are presently envisioned for removably attaching the cover 40 to the base 12, to provide a substantially watertight seal with the interchangeable insert 30 temporarily, removably locked therebetween.

Referring to FIG. 3A, a bottom surface 42 of transparent cover portion 40 includes locking slots 43, positioned to align with the slots 32 on the insert. These locking slots 43 are configured such that vertical portions 19 of lock tabs 18 will project into these slots, and the inward-projecting portions 20 will snap inward, thereby removably snap-locking the cover 40 in place on top of the base 12 with a substantially watertight seal. Washers (not shown) can be inserted between the base portion and the cover portion to enhance the watertight seal therebetween.

FIG. 3B broadly depicts structure for a partial thread attachment of base portion 12 and cover portion 40. Partial threads are provided on the bottom surface 42 of the cover 40, comprising outer slot portions 44, and internal slot portions 45. Outer slot portions 44 align with the wider portions of the insert slots 32. The lock tabs 18 insert into place through the wider portions of the slots 32 and into the outer slot portions 44, then twist into the internal slot portions 45, thereby removably locking the cover 40 into place on base 12 with a substantial watertight seal. Again, washers (not shown) can be inserted between the base portion and the cover portion to enhance the watertight seal.

FIG. 3C broadly depicts structure for a full thread attachment of base portion 12 to cover portion 40. As broadly embodied in FIG. 3C, a full circumferential thread 48 is provided on the lower surface 42 of the cover 40. Lock tabs 18 are inserted into place through the slots 32, the inwardly projecting portions 20 engage the full circumferential thread 48, and the lock tabs 18 are twisted until the cover 40 and the base 12 are removably locked together with the interchangeable insert removably, interchangeably locked therebetween with a substantial watertight seal. Once again, washers (not shown) may be inserted between the base portion and the cover portion to enhance the watertight seal.

The lock tabs 18 and the cover 40 can be manipulated by hand in order to disconnect the substantial watertight connection and remove the cover portion 40 from the base portion 12. The removability of the cover portion 40 from the base portion 12, and the interchangeability of the insert 30, enables the same decorative party apparatus 10 to be used and re-used in a number of different party situations, either with the same insert 30 or with a different insert 30.

For example, in the case of a birthday party, removable, interchangeable insert 30 can be, e.g., a photograph of the individual celebrating his or her birthday. For a graduation party, insert 30 can be, e.g., a photograph of the graduate in a cap and gown. For a political rally or inauguration party, insert 30 can be, e.g., a photograph of the candidate, a symbol of the political party, a slogan of the campaign, or the words "WE WIN." For a corporate picnic, insert 30 can be, e.g., a corporate logo, or one of the company's brand names, trademarks, or service marks.

Referring to FIGS. 7A-7B, for a wedding reception, insert 30 can, e.g., be a photograph of the bride and groom kissing at the altar. This photograph, or other photographs of the bride and groom or the bridal party, can be taken at the wedding ceremony, and e-mailed, via electronic notebook, digital camera, mobile phone, or other well-known electronic medium to a computer at the reception site, down-loaded, printed, and inserted in the customizable decorative party decorations 10 before the bridal party and the wedding guests arrive.

Other inserts 30 are possible and within the scope of the invention, e.g., team photographs, class or military unit reunion photographs, family photographs, holiday photographs, and sayings, e.g., "Happy New Year," "Happy St. Patrick's Day," "State Champions," "Baby's First Christmas," and so on.

As was the case with the preferred shapes discussed above, the invention is not limited to any replaceable inserts. While in use, the respective inserts 30 will be protected from damage by the substantial watertight connection between the respective base portions and the respective cover portions 40.

Moreover, once the cover portions 40 are removed from the base portions 12, the respective inserts 30 can be removed and stored for potential future re-use, and the party items themselves can be stored for potential future re-use.

As broadly embodied herein, and referring to FIGS. 1A-1C, 2, 4B, and 6, the customizable decorative party apparatus 10 in accordance with the invention is removably attachable to a plurality of party decorations. As broadly embodied herein, a connecting structure 50 is fixed to the second surface 16 of the base 12. Referring to FIGS. 1A, 1C, 2, and 4B, attachment device 50 comprises an adhesive pad, coated with a temporary adhesive compound. A number of well-known temporary adhesive compounds are commercially available, such as temporary adhesive compounds manufactured and sold by the 3M™ Corporation.

Figure 4A:
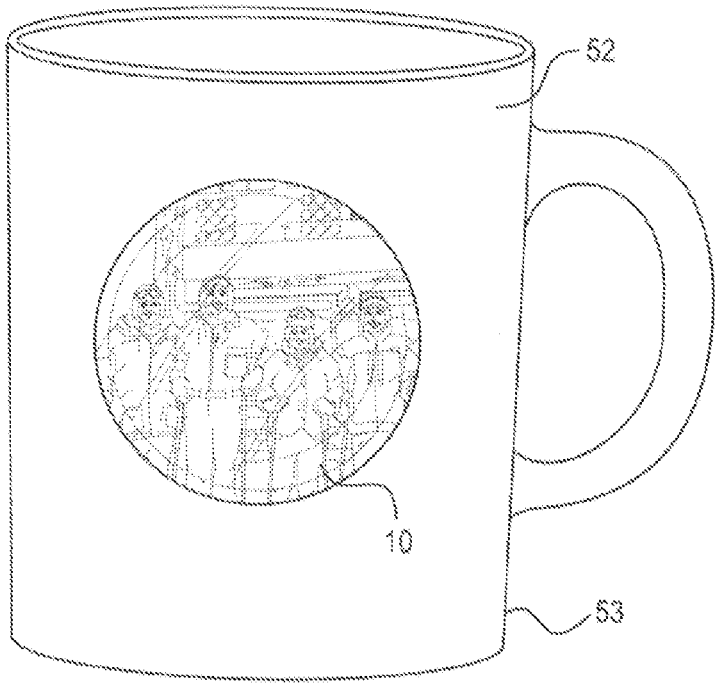
FIG. 4A is a front view depicting a customizable decorative party apparatus in accordance with the invention removably attached to a cup.
Figure 4B:
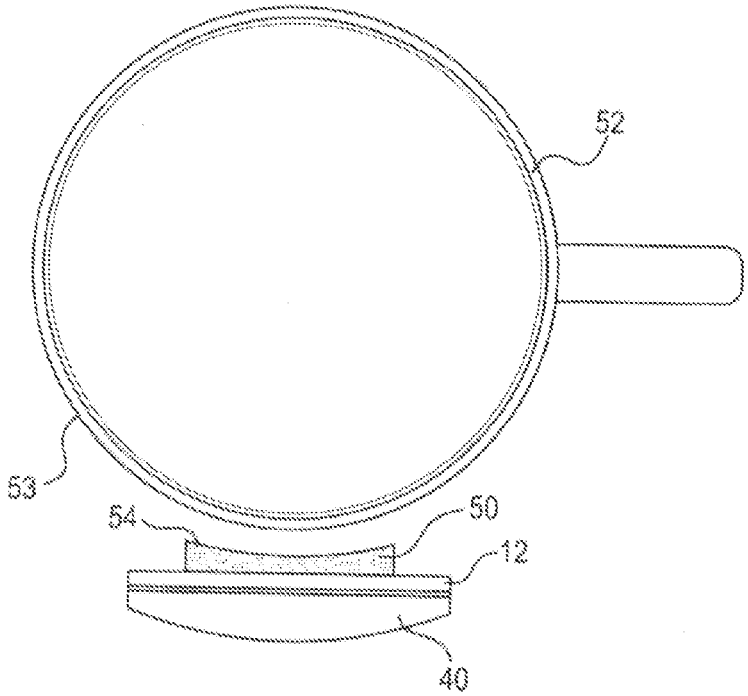
FIG. 4B is a top view of a customizable decorative party apparatus in accordance with the invention depicting a connecting structure for removably attaching the party apparatus to the cup of FIG. 4A.

FIG. 4A depicts one example of a customizable decorative party apparatus 10, removably attached to a cup 52. Referring to FIG. 4B, which depicts a top view of the cup of FIG. 4A, the cup 52 has an outer surface 53 defining a convex arc, and the attachment device 50 of the customizable decorative party apparatus has an inner surface 54, defining a concave arc. The concave arc of inner surface 54 is generally an inverse of the convex arc defined by the outer surface 53.

Figure 5A:
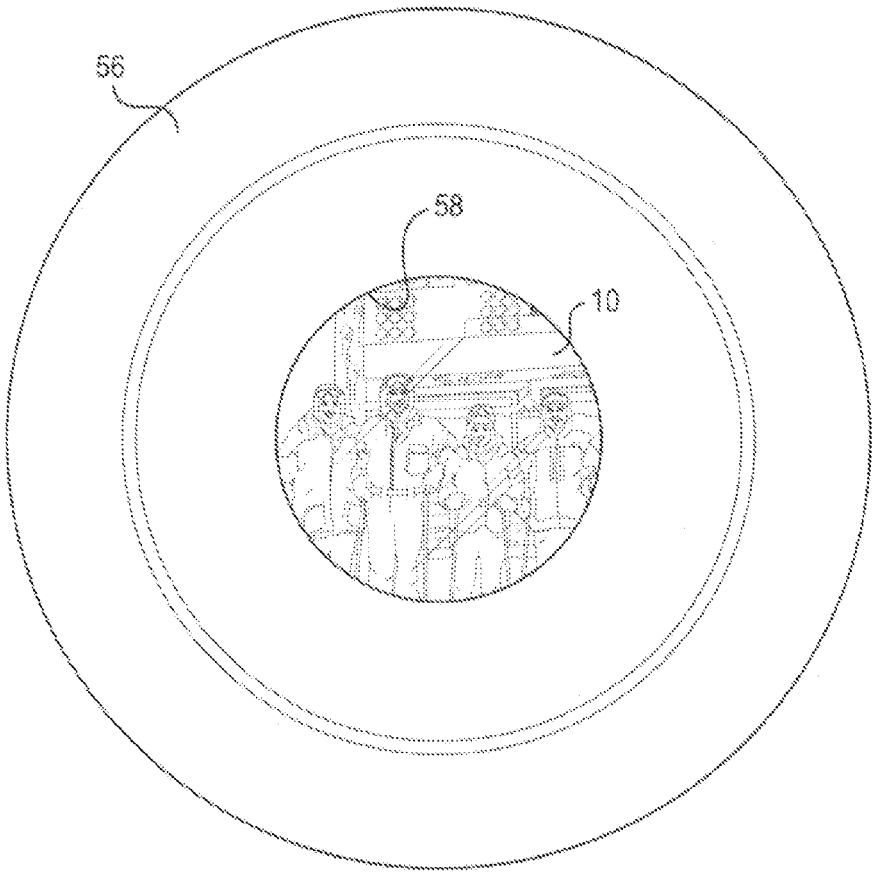
FIG. 5A is a top view depicting a customizable decorative party apparatus in accordance with the invention removably attached to a plate.

FIG. 5A depicts an example of a customizable decorative party apparatus 10, removably attached to a plate 56. In one preferred embodiment, a plate 56 can be specially configured with a central aperture 58, and the customizable decorative party apparatus 10 is attached in the central aperture 58.

Figure 5B:
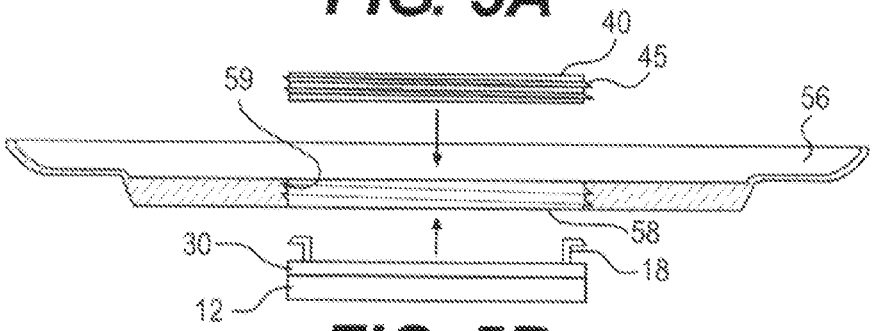
FIG. 5B is an exploded parts view depicting a first embodiment of removable attachment of a customizable decorative party apparatus in accordance with the invention to the plate of FIG. 5A.

FIG. 5B depicts a first preferred embodiment for attachment of a customizable decorative party apparatus 10 to a plate 56. The base portion 12, with the lock tabs 18, and the insert 30 are inserted upward into the central aperture 58 from below the plate. Next, the transparent cover portion 40 is inserted downward from above into the central aperture 58 of the plate 56, and attached to the base portion 12 to define a substantial watertight seal. In this embodiment, a peripheral side surface of transparent cover portion 40 is configured with external threads 48, which threadably engage with corresponding internal threads 59 in the central aperture 58 to removably connect the customizable decorative party apparatus 10 to the plate 56.

Figure 5C:
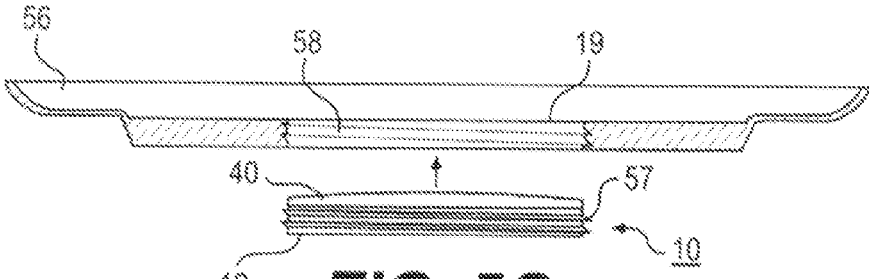
FIG. 5C is an exploded parts view depicting a second embodiment of removable attachment of a customizable decorative party apparatus in accordance with the invention to the plate of FIG. 5A.

FIG. 5C depicts another preferred embodiment for attachment of a customizable decorative party apparatus 10 to a plate 56. In this embodiment, a set of external threads 57 are provided on the outer periphery of the base 12. As depicted in FIG. 5C, the customizable decorative party apparatus 10 is first fully assembled, then inserted upward from below the plate 56, into the central aperture 58. When the external threads 57 engage the internal threads 59 of the central aperture 58, the customizable decorative party apparatus 10 is removably connected to the plate 56. Moreover, although the drawing depicts the customizable decorative party apparatus 10 being inserted upward into central aperture 58 from below the plate 56, it also is possible and within the scope of the invention to insert the fully assembled customizable decorative party apparatus 10 downward into central aperture 58 of plate 56.

It is also within the scope of the invention to use a plate 56 without a central aperture 58, and to adhere a customizable decorative party apparatus 10 to a surface of the plate 56 with a connecting structure 50 in the form of a temporary adhesive pad.

Figure 6:
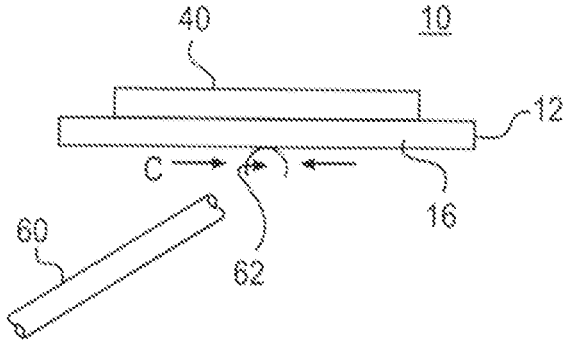
FIG. 6 is a perspective view depicting means for removable attachment of a customizable decorative party apparatus in accordance with the invention to a straw.

FIG. 6 depicts another embodiment of a customizable decorative party apparatus 10 configured for attachment to a drinking straw 60. In this embodiment, connecting device 50 comprises a flexible split ring 62, connected to the second side 16 of base portion 12. When the flexible split ring 62 is compressed by compressive force C, flexible split ring 62 is compressed to define substantially a 360 degree circle, with a diameter smaller than a diameter of the straw 60, thereby holding the customizable decorative party apparatus 10 in place on the straw 60.

Figure 8A:
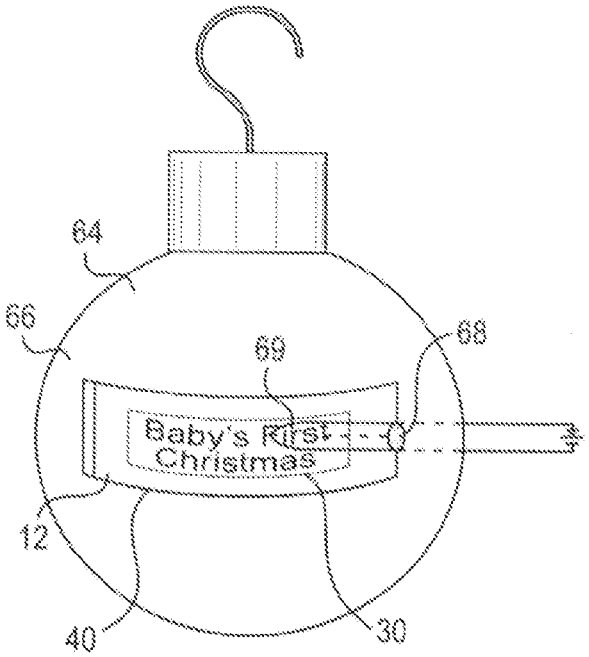
FIG. 8A is a front view depicting attachment of a customizable decorative party apparatus in accordance with the invention removably attached to a Christmas tree ornament, including an optional inserted light to illuminate the removable custom insert.

FIG. 8A depicts an embodiment of a customizable decorative party apparatus 10 configured for attachment to a Christmas tree ornament 64. In this embodiment, the ornament 64 typically is configured with a partial arcuate convex outer face 66 defining a convex arc. The attaching device 50 is again configured as an adhesive pad with a concave inner face, which is generally the inverse of the convex arc of the outer face 66, similar to the case of the cup embodiment in FIGS. 4A and 4B. As broadly embodied herein, the Christmas tree ornament embodiment preferably also has additional features. Insert 30 preferably is translucent. Moreover, the base portion 12 is configured on one surface with an aperture 68, sized to allow insertion therethrough of a light 69, preferably an LED. When in place behind the insert 30, illumination of the light 69 will transmit bright light through the translucent insert 30 and transparent cover 40, creating a dramatic visual effect. Although not shown in FIG. 8A, the shape of ornament 64 also could be, e.g., the shape of a pair of baby shoes, or the like.

Figure 8B:
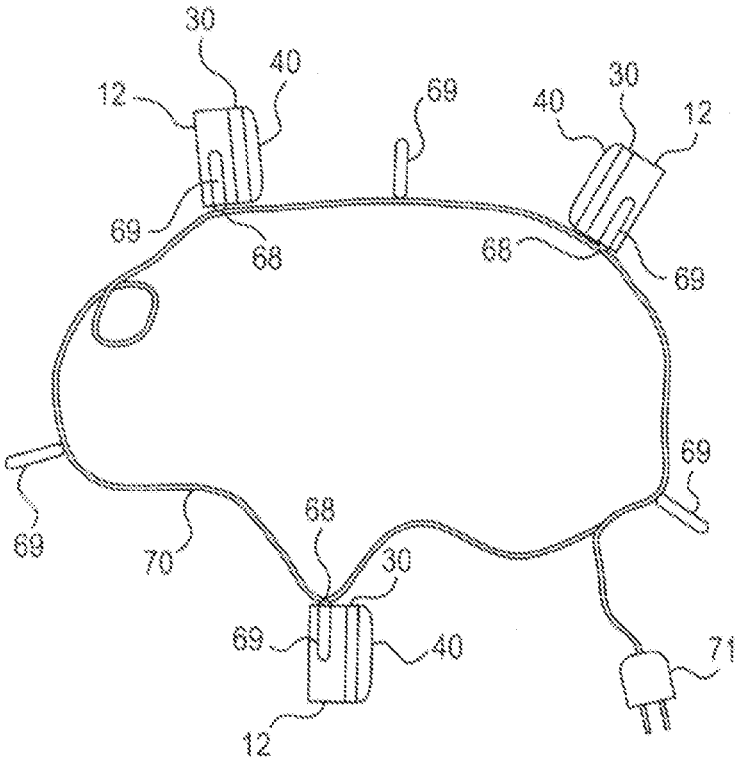
FIG. 8B is a top view of a string of Christmas tree lights, with certain lights inserted into customizable decorative party apparatuses in accordance with the invention.
Figure 10:
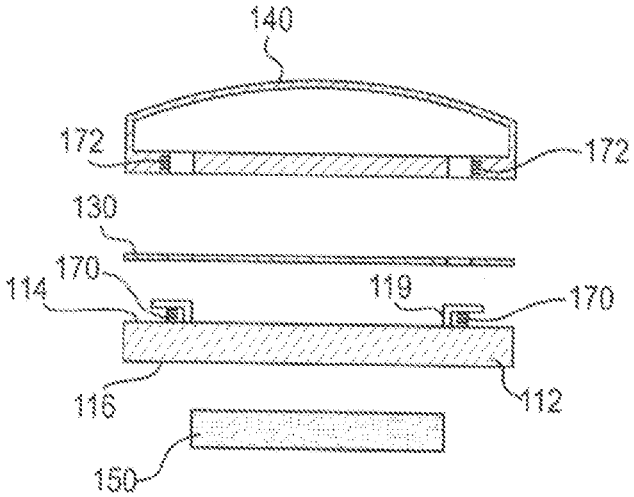
FIG. 10 is an exploded parts view of a customizable decorative party apparatus in accordance with the invention, substantially similar to FIG. 1, but with a different configuration for threadably attaching the cover portion to the base portion.

FIG. 10 depicts an electric cord 70 of Christmas tree lights 69, including a plug 71 for electric connection of the light cord 70 to a power source (not shown). Although an electric plug is shown in FIG. 8B for connection to an external power source, the electric cord 70 could have an internal power source, e.g., a battery. As broadly embodied in FIG. 8B, one or more lights 69 can be inserted through apertures 68 into the bases 12 of customizable decorative party apparatuses 10 in accordance with the invention, so that the lights 69 illuminate one or more interchangeable inserts 30. Moreover, the inserts can be translucent to create a more dramatic visual effect.

Figure 9A:
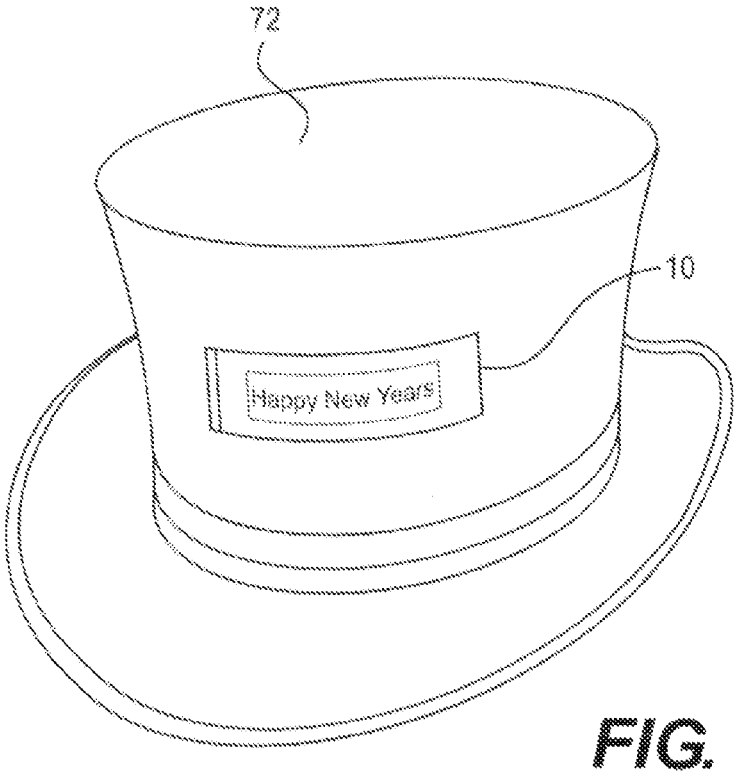
FIGS. 9A and 9B are front views depicting removable attachment of customizable decorative party apparatuses in accordance with the invention to respective party hats.
Figure 9B:
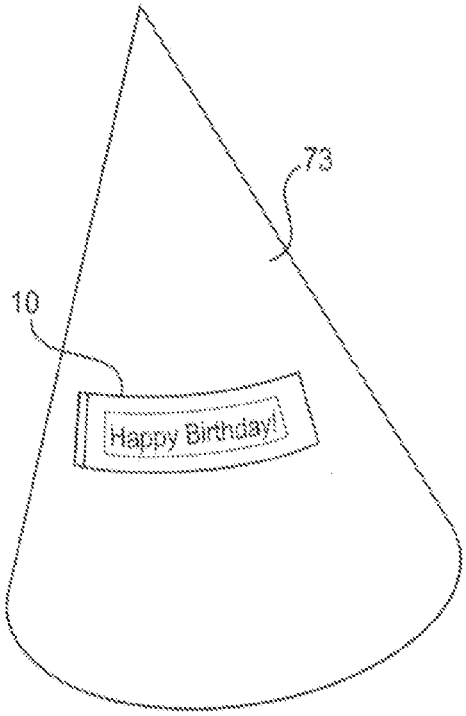

FIGS. 9A and 9B broadly depict another embodiment of a customizable decorative party apparatus 10, removably attachable to a hat, e.g., a New Year's Eve party hat 72 in FIG. 9A or a birthday party hat 73 in FIG. 9B.

Alternate embodiments of aspects of the present invention exist. As broadly embodied in FIG. 10 for example, a cover portion 140 threadably connects to a base portion 112, forming a substantially watertight seal with a removable interchangeable insert 130 therebetween. The connection is made by the mating of threads 170 provided on vertical portions 119 of lock tabs 118 with threads 172 provided on corresponding opposite-facing surfaces within cover portion 140. Once again, a washer (not shown) may be inserted between the base portion and the cover portion to enhance the watertight seal.

Figure 11:
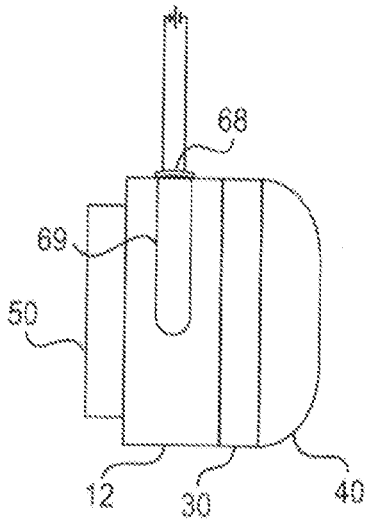
FIG. 11 is a side view of a customizable decorative party apparatus in accordance with the invention, substantially similar to FIG. 1C, but with a light inserted into the base to illuminate the insert.

Another alternate embodiment of the present invention, broadly depicted in FIG. 11, includes a light 69, preferably an LED, inserted through an aperture 68 into the base portion 12, in order to illuminate the insert 30. Preferably, insert 30 in this alternate embodiment is translucent, in order to enhance the visual effect.

Figure 12:
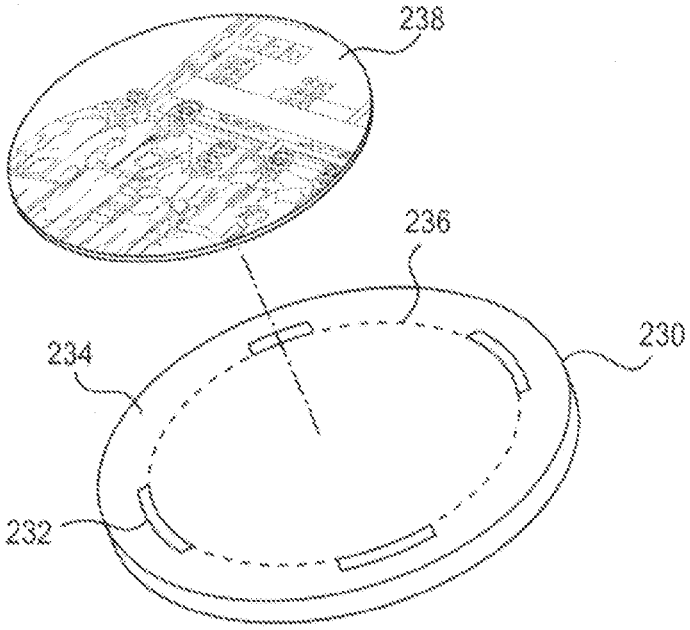
FIG. 12 is a perspective exploded parts view of an alternate embodiment of the removable interchangeable insert in accordance with the invention.

Yet another alternate embodiment involves the removable, interchangeable insert itself. As broadly embodied in FIG. 12, insert 230 includes a base 234, having a plurality of slots 232, for insertion therethrough of locking tabs (not shown). The slots 232 define an imaginary inner perimeter 236. A generally round removable sticker or disk 238, printed with the desired photograph, decal, logo, or emblem, inserts within the circle defined by the imaginary perimeter 236, with the space 234 outside the perimeter 236 to be covered by outer peripheral edges of the cover portion.

Still other embodiments of the invention will be apparent to those skilled in the art from consideration of the specification and practice of the invention disclosed herein. For example, one of ordinary skill will recognize that locking tabs, or threaded locking tabs, alternatively can be provided on the lower surface of the transparent cover, while locking slots, or threaded locking slots, alternatively can be provided on the first/upper surface of the base. One of ordinary skill also will recognize that different connecting structures can be configured for attachment to different party items, including but not limited to flatware, balloons, signs, banners, and so forth. For all of these reasons, the specification and the disclosed embodiments are to be considered as exemplary only, with a true scope and spirit of the invention being indicated by the following claims and their legal equivalents.

What is claimed is:

1. A customizable decorative party apparatus comprising:

a base portion having a generally planar first surface, a first locking element provided on the first surface, a second surface opposite the first surface, and a preselected shape;

a removable interchangeable insert having the preselected shape, configured to be inserted on the first surface;

a substantially transparent cover portion having a bottom surface, and a second locking element on the bottom surface; and a connecting structure affixed to the second surface, temporarily, removably connecting the base portion to a selected party item;

wherein the first surface of the base portion and the bottom surface of the cover portion are configured to removably attach to one another, with a substantially watertight seal being defined therebetween, by locking together the first locking element on the base portion with the second locking element on the cover portion, with the removable interchangeable insert held on the first surface; and wherein the substantially watertight connection is configured to disconnect via hand-manipulation of the base portion and the cover portion, to remove and exchange the insert with the same or another removable interchangeable insert.

2. The customizable decorative party apparatus of claim 1, wherein the preselected shape is generally circular.

3. The customizable decorative party apparatus of claim 1, wherein the preselected shape is generally bell shaped.

4. The customizable decorative party apparatus of claim 1, wherein the party item is one selected from the group consisting of holiday lights, cups, plates, hats, ornaments, and straws.

5. The customizable decorative party apparatus of claim 1 wherein the connecting structure comprises a temporary adhesive.

6. The customizable decorative party apparatus of claim 1, wherein the first locking element on the base portion comprises a lock tab extending from the first surface, and the second locking element on the cover portion comprises a locking structure in the bottom surface of the cover portion.

7. A customizable decorative party apparatus comprising:

a base portion having a generally planar first surface, a second surface opposite the first surface, and a preselected shape;

a removable interchangeable insert having the preselected shape, configured to be inserted on the first surface;

a substantially transparent cover portion having a bottom surface; and a connecting structure affixed to the second surface, temporarily, removably connecting the base portion to a selected party item;

wherein the first surface of the base portion and the bottom surface of the cover portion are configured to removably attach to one another, with the removable interchangeable insert held therebetween with a substantially watertight connection;

wherein the substantially watertight connection is configured to disconnect via hand-manipulation of the base portion and the cover portion, to remove and exchange the insert with the same or another removable interchangeable insert;

wherein the base portion comprises a lock tab extending from the first surface, and the cover portion comprises a locking structure in the lower surface of the cover portion; and wherein the locking structure in the lower surface of the cover portion comprises a locking slot, and the lock tab is configured and positioned to removably snap-lock into place in the locking slot.

8. The customizable decorative party apparatus of claim 6, wherein the second locking structure in the bottom surface of the cover portion comprises a thread, engageable by the lock tab on the base portion.

9. The customizable decorative party apparatus of claim 1, wherein the second locking element in the bottom surface of the cover portion comprises a full thread, engageable by the first locking element on the base portion, which comprises a lock tab.

10. A customizable decorative party apparatus, comprising:

a base portion having a generally planar first surface, a second surface opposite the first surface, and a preselected shape;

a removable interchangeable insert having the preselected shape, configured to be inserted on the first surface;

a substantially transparent cover portion having a bottom surface; and a connecting structure affixed to the second surface, temporarily, removably connecting the base portion to a selected party item;

wherein the first surface of the base portion and the bottom surface of the cover portion are configured to removably attach to one another, with the removable interchangeable insert held therebetween with a substantially watertight connection; and wherein the substantially watertight connection is configured to disconnect via hand-manipulation of the base portion and the cover portion, to remove and exchange the insert with the same or another removable interchangeable insert;

wherein the first surface of the base portion comprises projecting lock tabs with threads provided on vertical surfaces thereof, engageable with corresponding threads provided on opposing vertical surfaces within the cover portion.

11. The customizable decorative party apparatus of claim 1, wherein the party item is a cup, and the connecting structure is an adhesive pad on the surface of the base portion opposite to the surface supporting the insert, the adhesive pad temporarily adhering the base portion to the cup.

12. The customizable decorative party apparatus of claim 11, wherein an outer surface of the cup has a peripheral surface defining a convex arc, and the adhesive pad defines a concave arc which is an inverse of the convex arc defined by the outer surface of the cup.

13. The customizable decorative party apparatus of claim 1, wherein the party item is a straw having a first diameter, and the connecting structure is a generally circular split-ring, having an open position and a closed position, and a second diameter in the dosed position smaller than the first diameter.

14. The customizable decorative party apparatus of claim 1, wherein the party item is a plate having a central opening, the party apparatus is configured to be preassembled and inserted into the central opening of the plate, and to be temporarily threadably connected to the central opening, with the insert, protected by the cover portion, visible through the central opening.

15. The customizable decorative party apparatus of claim 1, wherein the party item is a plate having a central opening, the transparent cover portion is configured to be inserted into the central opening, and to be threadably connected to the central opening, and the base portion is configured to be inserted, into the central opening, into removable locking engagement with the cover portion, with the insert, protected by the cover portion, visible though the central opening.

16. The customizable decorative party apparatus of claim 1, wherein the interchangeable, replaceable insert is one selected from the group consisting of photographs, slogans, phrases, brand names, logos, and symbols.

17. The customizable decorative party apparatus according to claim 1, wherein the removable, interchangeable insert comprises a base with slots defining an inner periphery, and a photograph, decal, logo, symbol, or sticker removably attached within the inner periphery.

18. The customizable decorative party apparatus of claim 1, wherein the base portion is configured to attach to an ornament, and the apparatus further comprises a slot in the base portion for insertion of an insert-illuminating light therein.

19. The customizable decorative party apparatus of claim 1, further comprising an aperture in the base portion configured to receive a light therethrough, into the base portion, to illuminate the insert.

20. The customizable decorative party apparatus of claim 19, herein the insert is translucent.

21. A string of customizable decorative holiday lights comprising:

an electric cord connected to a power source;

a plurality of lights electrically connected to the cord;

a plurality of customizable decorative ornaments, each said ornament comprising:

a base portion having a surface, a first locking element provided on the surface, a preselected configuration, and an aperture;

a removable, interchangeable insert having a configuration generally corresponding to the preselected configuration, and configured to be inserted on the surface of the base portion; and a generally transparent cover portion, having a second locking element, removably attachable to the base portion by locking the first locking element on the base portion with the second locking element on the cover portion, the locking of the first and second locking elements defining a substantially watertight seal therebetween, with the removable interchangeable insert held on the surface of the base portion;

wherein the aperture is configured for insertion therethrough of one of the plurality of lights, into the base portion, to illuminate the insert.

22. The string of customizable holiday lights of claim 21, wherein the insert is translucent.

23. A method of assembling a customizable decorative party apparatus comprising:

providing a base portion having an upper surface, a first locking element provided on the upper surface, a lower surface, a temporary connecting device attached to the lower surface, and a preselected shape;

providing a plurality of removable interchangeable inserts having the preselected shape;

providing a generally transparent cover portion having a second locking element, and the preselected shape, removably attachable to the upper surface of the base portion;

applying the removable interchangeable insert onto the upper surface of the base portion;

removably attaching the base portion and the cover portion together, defining a watertight seal therebetween by locking the first locking element on the base portion with the second locking element on the cover portion, with the removable interchangeable insert held on the upper surface of the base portion; and temporarily connecting the base portion to one of a plurality of party items with the connecting device.

24. The method of claim 23, wherein the cover portion and the base portion are attached to one another via threadable engagement between the first locking element, comprising threads on the base portion, and the second locking element, comprising corresponding threads in the cover portion.

25. The method of claim 23, wherein the cover portion and the base portion are attached to one another via the first locking element, comprising threads on projecting portions on the upper surface of the base portion engaging the second locking element, comprising corresponding threads within the cover portion.

26. The method of claim 23, wherein at least one of the first and second locking elements comprises a partial thread.

27. The method of claim 23, wherein at least one of the first and second locking elements comprises a full thread.

28. The method of claim 23, wherein the removable interchangeable insert is selected from the group consisting of photographs, slogans, phrases, logos, and symbols.

29. The method of claim 23, wherein providing the base portion comprises providing a base portion with a connecting device configured to temporarily connect the base to one of the group consisting of holiday light strings, cups, plates, straws, and hats.

30. The method of clam 23, further comprising inserting a light into the base portion to illuminate the insert.

31. A customizable decorative holiday ornament, comprising:

a first portion having a preselected shape, a first annular surface, and an aperture adapted to receive therethrough, a light on a string of lights;

a substantially transparent second portion, having a second annular surface, removably connectable with the first portion; and a removable, interchangeable generally translucent insert having the preselected shape, adapted to be inserted and removably mounted on the first portion, and held in place thereon by the removable connection of the first portion and the second portion, and to be visible through the substantially transparent second portion when backlit by the light;

wherein one of the first portion and the second portion has a generally hemispherical configuration, and the other of the first portion and the second portion has a generally planar configuration.

32. The customizable decorative holiday ornament of claim 31, wherein the first portion and the second portion are adapted to be twisted into removable connection.

33. A customizable decorative holiday apparatus comprising:

a first portion having a preselected shape and an aperture adapted to receive therethrough a light on a string of lights;

a substantially transparent second portion, removably connectable with the first portion; and a removable, interchangeable generally translucent insert having the preselected shape, adapted to be inserted and removably mounted between the first portion and the second portion, and to be visible through the substantially transparent second portion when backlit by the light;

wherein one of the first portion and the second portion has a generally hemispherical configuration, and the other of the first portion and the second portion has a generally planar configuration; and wherein locking tabs provided on one of the first portion and the second portion and slots on the other of the first portion and the second portion are configured such that the first portion and the second portion to be twisted into removable connection.

34. The customizable decorative holiday apparatus of claim 32, further comprising a thread provided on at least one of the first portion and the second portion configured such that the first portion and the second portion can be twisted into removable connection.

35. The customizable decorative holiday ornament of claim 31, wherein the first portion and the second portion are adapted to be snapped into removable connection.

36. A customizable decorative holiday apparatus comprising:

a first portion having a preselected shape and an aperture adapted to receive therethrough a light on a string of lights;

a substantially transparent second portion, removably connectable with the first portion; and a removable, interchangeable generally translucent insert having the preselected shape, adapted to be inserted and removably mounted between the first portion and the second portion, and to be visible through the substantially transparent second portion when backlit by the light;

wherein one of the first portion and the second portion has a generally hemispherical configuration, and the other of the first portion and the second portion has a generally planar configuration; and wherein locking tabs provided on one of the first portion and the second portion and slots on the other of the first portion and the second portion are configured such that the first portion and the second portion to be snapped into removable connection.

37. A method of assembling a customized decorative holiday apparatus, comprising:

utilizing a first portion having a preselected shape and an aperture adapted to receive therethrough a light on a string of lights;

utilizing a first removable, interchangeable generally translucent insert having the preselected shape;

utilizing a substantially transparent second portion adapted to be connected with the first portion;

wherein one of the first portion and the second portion has a generally hemispherical configuration and an annular surface, and the other of the first portion and the second portion has a generally planar configuration and a planar surface;

removably connecting the second portion and the first portion with the first insert mounted on the annular surface, and held in place thereon by the connection of the first portion with the second portion; and inserting the light though the aperture to backlight the generally translucent insert, thereby making the insert visible through the generally transparent second portion.

38. The method of claim 37, further comprising:

disconnecting the first portion from the second portion;

removing the first removable, interchangeable generally translucent insert;

inserting a second removable, generally translucent interchangeable insert; and reconnecting the first portion and the second portion, with the second removable, generally translucent interchangeable insert mounted therebetween.

39. The method of claim 37, wherein removably connecting the first portion and the second portion includes twisting the first portion and the second portion together.

40. A method of assembling a customized decorative holiday apparatus, comprising:

utilizing a first portion having a preselected shape and an aperture adapted to receive therethrough a light on a string of lights;

utilizing a first removable, interchangeable generally translucent insert having the preselected shape;

utilizing a substantially transparent second portion adapted to be connected with the first portion;

wherein one of the first portion and the second portion has a generally hemispherical configuration, and the other of the first portion and the second portion has a generally planar configuration;

removably connecting the second portion and the first portion with the first insert mounted therebetween;

inserting the light through the aperture to backlight the generally translucent insert, thereby making the insert visible through the generally transparent second portion;

whereby removably connecting the first portion and the second portion includes twisting the first portion and the second portion together; and wherein twisting the first and second portions together includes inserting locking tabs provided on one of the first and second portions into slots defined in the other of the first and second portions and twisting at least one of the first and second portions.

41. A method of assembling a customized decorative holiday apparatus, comprising:

utilizing a first portion having a preselected shape and an aperture adapted to receive therethrough a light on a string of lights;

utilizing a first removable, interchangeable generally translucent insert having the preselected shape;

utilizing a substantially transparent second portion adapted to be connected with the first portion;

wherein one of the first portion and the second portion has a generally hemispherical configuration, and the other of the first portion and the second portion has a generally planar configuration;

removably twisting the first portion and the second portion together with the first insert therebetween; and inserting light through the aperture to backlight the generally translucent insert, thereby making the insert visible through the generally transparent second portion, wherein one of the first portion and the second portion has a generally hemispherical configuration, and the other of the first portion and the second portion has a generally planar configuration;

removably twisting the first portion and the second portion together with the first insert therebetween; and inserting the light through the aperture to backlight the generally translucent insert, thereby making the insert visible through the generally transparent second portion; and wherein removably twisting the first and second portions together includes inserting locking tabs provided on one of the first and second portions into a thread defined in the other of the first and second portions and twisting at least one of the first and second portions.

42. The method of claim 39, wherein twisting the first and second portions together includes inserting a thread provided on one of the first and second portions into a thread defined on the other of the first and second portions and twisting at least one of the first and second portions.

43. The method of claim 37, wherein removably connecting the first portion and the second portion includes snapping the first portion and the second portion together.

44. A method of assembling a customized decorative holiday apparatus, comprising:

utilizing a first portion having a preselected shape and an aperture adapted to receive therethrough a light on a string of lights;

utilizing a first removable, interchangeable generally translucent insert having the preselected shape;

utilizing a substantially transparent second portion adapted to be connected with the first portion;

wherein one of the first portion and the second portion has a generally hemispherical configuration, and the other of the first portion and the second portion has a generally planar configuration;

removably connecting the second portion and the first portion with the first insert mounted therebetween; and inserting the light through the aperture to backlight the generally translucent insert, thereby making the insert visible through the generally transparent second portion;

wherein removably connecting the first portion and the second portion includes snapping the first portion and the second portion together; and wherein snapping the first and second portions together includes inserting locking tabs provided on one of the first and second portions into slots defined in the other of the first and second portions.

* * * * *